United States Patent [19]

Ming

[11] Patent Number: 4,840,599

[45] Date of Patent: Jun. 20, 1989

[54] WHEEL FOR A TOY VEHICLE AND A TOY VEHICLE HAVING SUCH A WHEEL

[75] Inventor: Alex L. K. Ming, New Territories, Hong Kong

[73] Assignee: Unimax Distribution Limited, Kowloon, Hong Kong

[21] Appl. No.: 11,432

[22] Filed: Jan. 29, 1987

[30] Foreign Application Priority Data

Jan. 30, 1986 [GB] United Kingdom ..... 8602291

[51] Int. Cl.[4] ..... A63H 17/00

[52] U.S. Cl. ..... 446/465; 301/118; 301/9 DH

[58] Field of Search ..... 446/465, 469, 431, 95, 446/471; 301/118, 36 R, 63 PW, 9 DH, 9 S, 9 AH, 17, 9 CN

[56] References Cited

U.S. PATENT DOCUMENTS

| | | | |
|---|---|---|---|
| 2,323,813 | 7/1943 | Fred | 301/118 |
| 2,335,548 | 11/1943 | Spahn | 301/9 DH |
| 3,365,236 | 1/1968 | Snedeker | 301/9 DH |
| 4,299,051 | 11/1981 | Pauley et al. . | |
| 4,448,455 | 5/1984 | Ellegaard | 301/36 R |

FOREIGN PATENT DOCUMENTS

| | | | |
|---|---|---|---|
| 2575935 | 7/1986 | France | 446/95 |
| 2019231 | 10/1979 | United Kingdom . | |
| 2042912 | 10/1980 | United Kingdom | 446/469 |

*Primary Examiner*—Mickey Yu

*Attorney, Agent, or Firm*—Lowe, Price, LeBlanc, Becker & Shur

[57] ABSTRACT

A wheel for a toy vehicle has a device whereby the wheel can be releasably and coaxially attached to a hub mounted on an axle of the toy vehicle and/or to another wheel by way of a bayonet coupling so that wheels can be easily added or removed to increase or decrease the number of wheels on any axle or to interchange wheels with different tire treads. The coupling device is supported relative to a rim of the wheel so as to be coaxial therewith and angularly movable relative thereto. The coupling device has a part on an outer side of the wheel for enabling the coupling device to be turned angularly and a first part of the bayonet coupling on the inner side of the wheel. The second part of the bayonet coupling is provided on the hub and/or a like wheel.

16 Claims, 3 Drawing Sheets

WHEEL FOR A TOY VEHICLE AND A TOY VEHICLE HAVING SUCH A WHEEL

BACKGROUND OF THE INVENTION

This invention relates to a wheel for a toy vehicle and a toy vehicle having such a wheel.

It is known from U.S. Pat. No. 4,299,051 and GB No. 2019231A to provide demountable wheels for a toy vehicle.

These wheels can however only be mounted on and demounted from a wheel axle.

GENERAL DESCRIPTION OF THE PRESENT INVENTION

The present invention provides a wheel for a toy vehicle, comprising a coupling device for releasably and coaxially attaching the wheel to a hub mounted on an axle of a toy vehicle or to another wheel. In one aspect the coupling device is coaxial with a rim of the wheel and has a first part of a bayonet coupling on an inner side of the wheel for co-operating with a second part of a bayonet coupling on the hub or the another wheel. The wheel has a said second part of a bayonet coupling on the outer side of the wheel for co-operating with a said first part of a bayonet coupling on a like wheel. In another aspect, the coupling device is supported relative to a rim of the wheel so as to be coaxial therewith and angularly movable relative thereto. The coupling device has a part on an outer side of the wheel for enabling the coupling device to be turned angularly and a first part of a bayonet coupling on the inner side of the wheel for co-operating with a second part of a bayonet coupling on said hub or said another wheel.

Bayonet couplings are probably most commonly used to connect a lamp to a lamp holder. Such bayonet couplings usually comprise two projecting pins on the lamp and bayonet slots on the lamp holder, which have a circumferential component and an axial component at their inner ends. It is to be understood however that the term 'bayonet coupling' as used herein is not to be so limited. The slots need have only a circumferential component and the aforesaid pins can instead be any appropriate form of projection which cooperate with the slots.

The present invention also provides toy vehicles having such a wheel.

With such an arrangement a wheel can be releasably and coaxially attached to a hub mounted on an axle of the toy vehicle and/or to another wheel by way of a bayonet coupling so that wheels can be easily added or removed to increase or decrease the number of wheels on any axle or to interchange wheels with different tire treads.

DESCRIPTION OF THE PREFERRED EMBODIMENT

Figure 1:
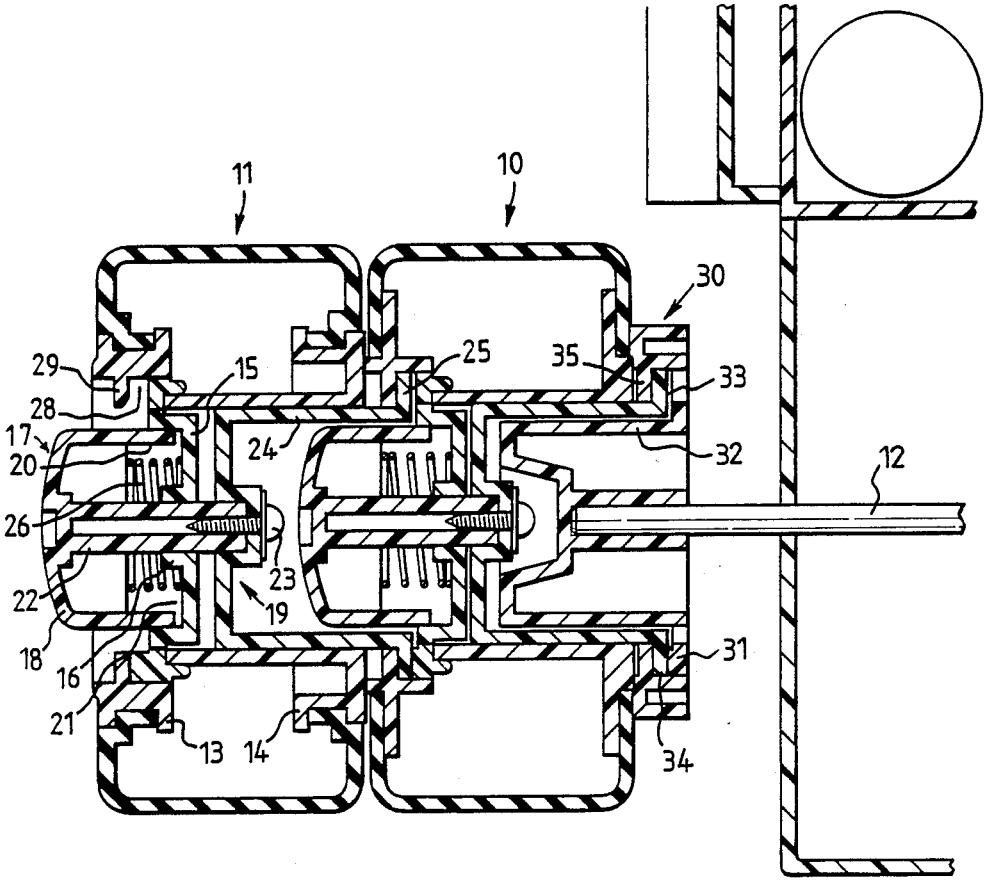
FIG. 1 is a horizontal section taken through a wheel and hub assembly of a toy vehicle embodying the invention.
Figure 2:
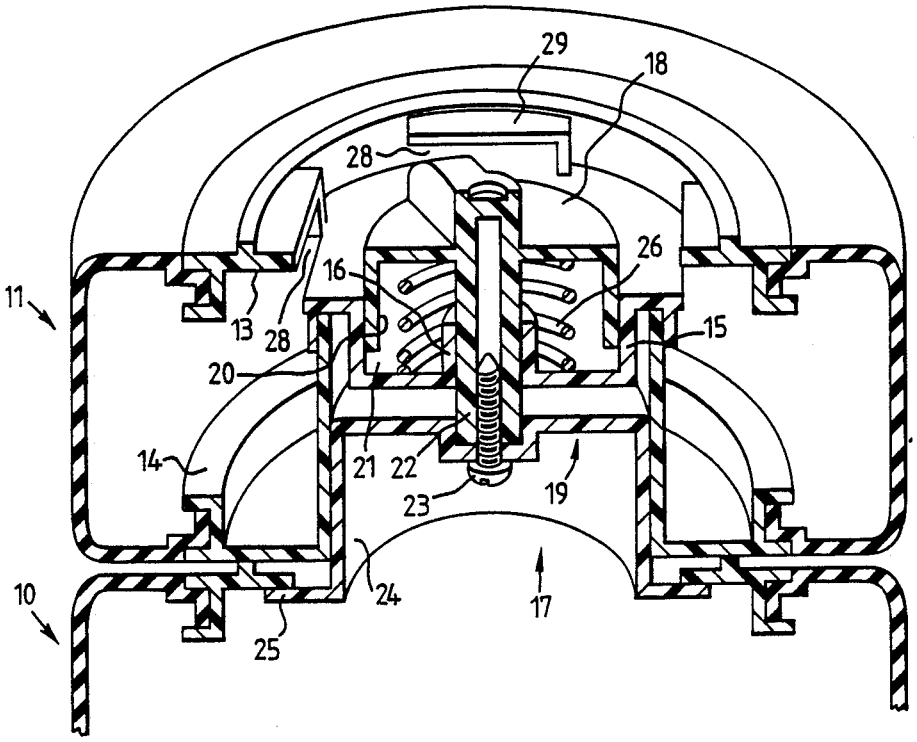
FIG. 2 is a perspective view of one of the wheels of FIG. 1 and part of another wheel of FIG. 1 both of which have been sectioned for reasons of clarity.
Figure 3:
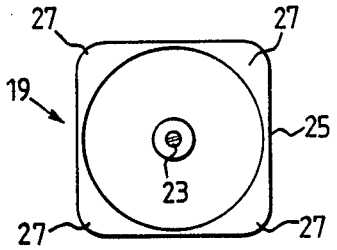
FIG. 3 is an end view of the cup-shaped part of the coupling device shown in FIGS. 1 and 2.

Referring now to FIG. 1 of the drawings there is shown therein two wheels 10 and 11 supported relative to an axle 12 of a toy motor vehicle. The vehicle has two or more axles at least one of which can be power driven by a battery operated motor. In one example there are two such axles and both axles are power driven.

Each wheel comprises a rim formed of two parts 13 and 14 which are secured together and which define peripheral grooves for mounting a tire on the rim. The rim part 13 has an integral deeply dished disc 15 which has a collar 16 at its centre defining a through aperture.

The wheel also has a coupling device 17 comprising a knob 18 on the outer side of the disc 15 and a generally cup-shaped member 19 on the inner side of the disc 15.

The knob 18 has a cylindrical skirt 20 which is mounted in a recess 21 defined by the dished disc 15 and a central boss 22 which extends through the collar 16.

The base of the cup-shaped member 19 is secured to the boss 22 by a screw threaded fastener 23 so as to be both axially and angularly movable with the knob 18. The cup-shaped member 19 has a cylindrical wall 24 disposed in the rim of the wheel and an outwardly projecting flange 25 lying proud of the inner side of the wheel, the flange having a generally polygonal peripheral surface (e.g. square) but with rounded corners for a purpose which will become apparent hereinafter.

The coupling device 17 is capable of limited axial movement relative to the rim of the wheel between a position in which the base of the cup-shaped member 19 contacts the disc 15 and a position in which the rim of the skirt 20 of the knob 18 engages the base of the recess in the disc 15.

A compression spring 26 is mounted about the collar 16 and the boss 22 and is axially disposed between the base of the recess 21 in the disc 15 and the knob 18. This spring 26 urges the coupling device towards its outer limit position, i.e. that position in which the base of the cup-shaped member 19 contacts the disc 15.

The corners of the flange 25 define lugs 27 of a bayonet coupling, although other forms of projection could suffice equally well. In the example shown, in which the flange 25 has a rounded square peripheral edge, there are four such lugs 27.

The wheel is also provided with bayonet slots 28 which correspond in number to the number of lugs 27 and which are defined by generally L-shaped portions 29 projecting radially inwards from the rim part 13 of the wheel. These slots 28 co-operate with lugs 27 on a like wheel in a manner which will be more fully explained hereinafter in order to attach one wheel to another.

A hub 30 is fixed to each end of each axle 12, although if the axle is not power driven the hub 30 could be mounted on the axle for rotation relative thereto.

The hub 30 comprises a disc 31 having a coaxially outwardly projecting central boss 32 and an annular groove 33 in the disc and surrounding the boss. The hub 30 is also provided with a plurality of bayonet slots 34 which correspond in number to the number of lugs 27 on the coupling device 17 of a wheel and which are defined by generally L-shaped portions 35 projecting radially inwards from the outer wall of the groove 32.

In order to attach one wheel 10 to the hub 30 or the wheel 11 to the wheel 10, when the latter is attached already to the hub, the flange 25 of the coupling device of the wheel to be attached is inserted into the groove 32 of the hub 30 or into the inside of the rim part 13 of the wheel 10. The knob 18 is then depressed against the urging force of the spring 26 and twisted through a small angle in order to locate the lugs 27 of the flange 26 in corresponding bayonet slots 34 or 28 in the hub 30 or the wheel 10, respectively. The knob 18 is then released and the spring 26 urges the coupling device 17 outwardly in order to bring the lugs 27 into contact with the inner surface of one limb of the associated L-shaped portions 35 or 29.

In order to detach the wheel 11 from the wheel 10 or the wheel 10 from the hub 30 the knob 18 of the corresponding coupling device 17 is again depressed and twisted in the opposite angular direction.

Figure 4:
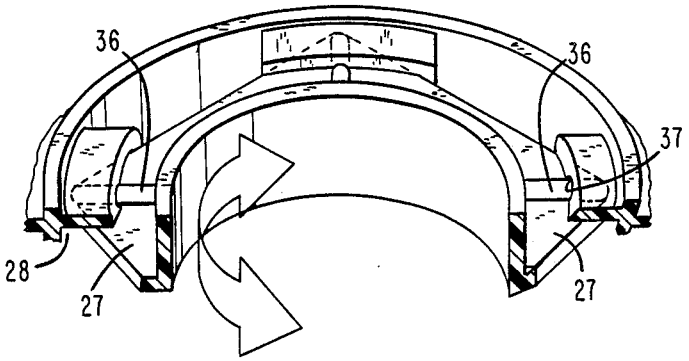
FIG. 4 is a detail view showing a modified bayonet coupling between the wheels of FIG. 2.

In the modified bayonet coupling shown in FIG. 4, each lug 27 has a protrusion in the form of a radially extending rib 36 which co-operates with a recess in the form of a groove 37 in the wall of the bayonet slot 28 (or 34). The ribs 36 and grooves 37 prevent unintentional detachment of the wheel 11 from the wheel 10 (or the wheel 10 from the hub 30). The ribs 36 and grooves 37 could, of course, be reversed.

It will be appreciated that such an arrangement enables a child to easily add or remove wheels either to increase or decrease the number of wheels on any axle or to interchange wheels with different tire treads which may be supplied with the vehicle or which may be purchased separately.

The invention is not limited to the particular embodiment described above and many modifications could be made without departing from the scope of the invention as defined in the appended claims.

For example, one wheel may be permanently attached to each end of each axle and the coupling device need then be provided only to connect one wheel to another. Alternatively the coupling device may be provided to attach a wheel to a hub mounted on an axle and not to attach one wheel to another.

What I claim is:

1. A wheel for a toy vehicle, comprising a coupling device for releasably and coaxially attaching the wheel to a hub mounted on an axle of a toy vehicle or to another wheel, the coupling device being supported relative to a rim of the wheel so as to be coaxial therewith and angularly movable relative thereto, the coupling device having a part on an outer side of the wheel for enabling the coupling device to be turned angularly, and a first part of a bayonet coupling on the inner side of the wheel for co-operating with a second part of a bayonet coupling on said hub or said another wheel, the wheel having a said second part of a bayonet coupling on the outer side of the wheel for co-operating with a said first part of a bayonet coupling on a like wheel.

2. The wheel of claim 1, wherein the first part of the bayonet coupling comprises a plurality of angularly spaced projections for cooperating with complementary bayonet slots on said hub or said another wheel.

3. The wheel of claim 2, wherein each projection is provided with one of a protrusion and a recess which extends transversely to a plane of the projections for co-operating with a corresponding one of a recess and protrusion in a part defining a respective bayonet slot.

4. The wheel of claim 2, wherein the first part of the bayonet coupling comprises a cup-shaped member having a cylindrical wall and an outwardly projecting flange abutting against the inner surface of the wheel, the flange having a generally polygonal peripheral edge having corner portions which define the aforesaid projections.

5. The wheel of claim 1, wherein the coupling device is capable of limited axial movement relative to the wheel and wherein resilient means are provided to urgee the coupling device towards an outer limit position thereof.

6. The wheel of claim 1, wherein the first part of the bayonet coupling comprises a plurality of angularly spaced projections and wherein the said second part of the bayonet coupling comprises a plurality of angularly spaced bayonet slots equal in number to the number of projections on the said first part of the bayonet coupling.

7. The wheel of claim 1, further comprising a hub adapted to be mounted on an axle of a toy vehicle, the hub having a said second part of a bayonet coupling for co-operating with the first part of a bayonet coupling on the wheel.

8. The combination of claim 7, wherein the first part of the bayonet coupling comprises a plurality of angularly spaced projections and wherein the second part of the bayonet coupling comprises a plurality of angularly spaced bayonet slots equal in number to the number of projections on the said first part of the bayonet coupling.

9. A wheel for a toy vehicle, comprising a coupling device for releasably and coaxially attaching the wheel to a hub mounted on an axle of a toy vehicle or to another wheel, the coupling device being coaxial with a rim of the wheel and having a first part of a bayonet coupling on an inner side of the wheel for co-operating with a second part of a bayonet coupling on said hub or said another wheel, the wheel having a said second part of a bayonet coupling on the outer side of the wheel for co-operating with a said first part of a bayonet coupling on a like wheel.

10. The wheel of claim 9, wherein the first part of the bayonet coupling comprises a plurality of angularly spaced projections for co-operating with complementary bayonet slots on said hub or said another wheel.

11. The wheel of claim 10, wherein each projection is provided with one of a protrusion and a recess which extends transversely to a plane of the projections for co-operating with a corresponding one of a recess and protrusion in a part defining a respective bayonet slot.

12. The wheel of claim 10, wherein the first part of the bayonet coupling comprises a cup-shaped member having a cylindrical wall and an outwardly projecting flange abutting against the inner surface of the wheel, the flange having a generally polygonal peripheral edge having corner portions which define the aforesaid projections.

13. The wheel of claim 9, wherein the coupling device is capable of limited axial movement relative to the wheel and wherein resilient means are provided to urge the coupling device towards an outer limit position thereof.

14. The wheel of claim 9, wherein the first part of the bayonet coupling comprises a plurality of angularly spaced projections and wherein the said second part of the bayonet coupling comprises a plurality of angularly spaced bayonet slots equal in number to the number of projections on the said first part of the bayonet coupling.

15. The wheel of claim 9 further comprising a hub adapted to be mounted on an axle of a toy vehicle, the hub having a said second part of a bayonet coupling for co-operating with the first part of a bayonet coupling on the wheel.

16. The combination of claim 15, wherein the first part of the bayonet coupling comprises a plurality of angularly spaced projections and wherein the second part of the bayonet coupling comprises a plurality of angularly spaced bayonet slots equal in number to the number of projections on the said first part of the bayonet coupling.

* * * * *